US007513353B2

(12) United States Patent
Bolen

(10) Patent No.: US 7,513,353 B2
(45) Date of Patent: Apr. 7, 2009

(54) COIN MECHANISM

(76) Inventor: Richard Bolen, P.O. Box 490, Morris, IL (US) 60450

( * ) Notice: Subject to any disclaimer, the term of this patent is extended or adjusted under 35 U.S.C. 154(b) by 0 days.

(21) Appl. No.: 10/403,479

(22) Filed: Mar. 31, 2003

(65) Prior Publication Data

US 2004/0188222 A1 Sep. 30, 2004

(51) Int. Cl.
*G07D 5/02* (2006.01)

(52) U.S. Cl. ..... 194/334

(58) Field of Classification Search ..... 194/292, 194/236, 237, 255, 334, 337, 338, 226
See application file for complete search history.

(56) References Cited

U.S. PATENT DOCUMENTS 3,604,547 A * 9/1971 Bolen ..... 194/2
3,738,467 A * 6/1973 Zajac et al. ..... 194/72
3,937,314 A * 2/1976 Rosenberg et al. ..... 194/63
5,111,928 A * 5/1992 Kovens ..... 194/292
5,383,545 A * 1/1995 Schwarzli ..... 194/202
5,950,793 A * 9/1999 Schwarzli ..... 194/236

* cited by examiner

*Primary Examiner*—Jeffrey A Shapiro
(74) *Attorney, Agent, or Firm*—Wildman, Harrold, Allen & Dixon LLP; Thomas J. Ring

(57) ABSTRACT

A combination pawl and coin wheel for use in a vending machine is disclosed. The pawl has a beveled disk-engaging tooth adapted to engage a disk or coin at a coin corner so as to urge that coin against wheel surfaces and thereby inhibit coin rotation while the coin is in the pocket. Coin wheel wear is thus inhibited, and vending machine maintenance is minimized.

16 Claims, 6 Drawing Sheets

Fig. 1
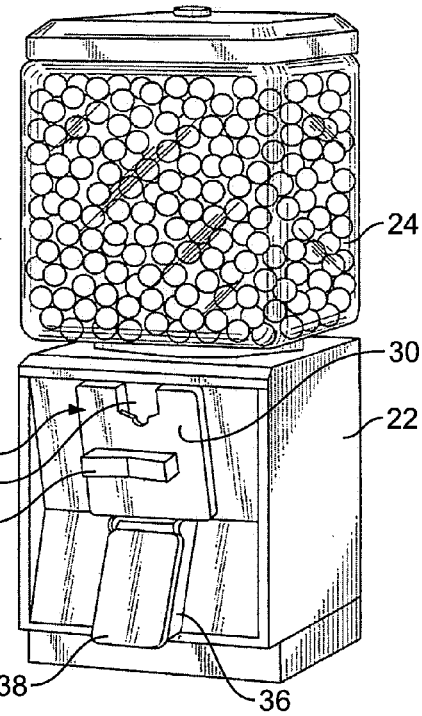
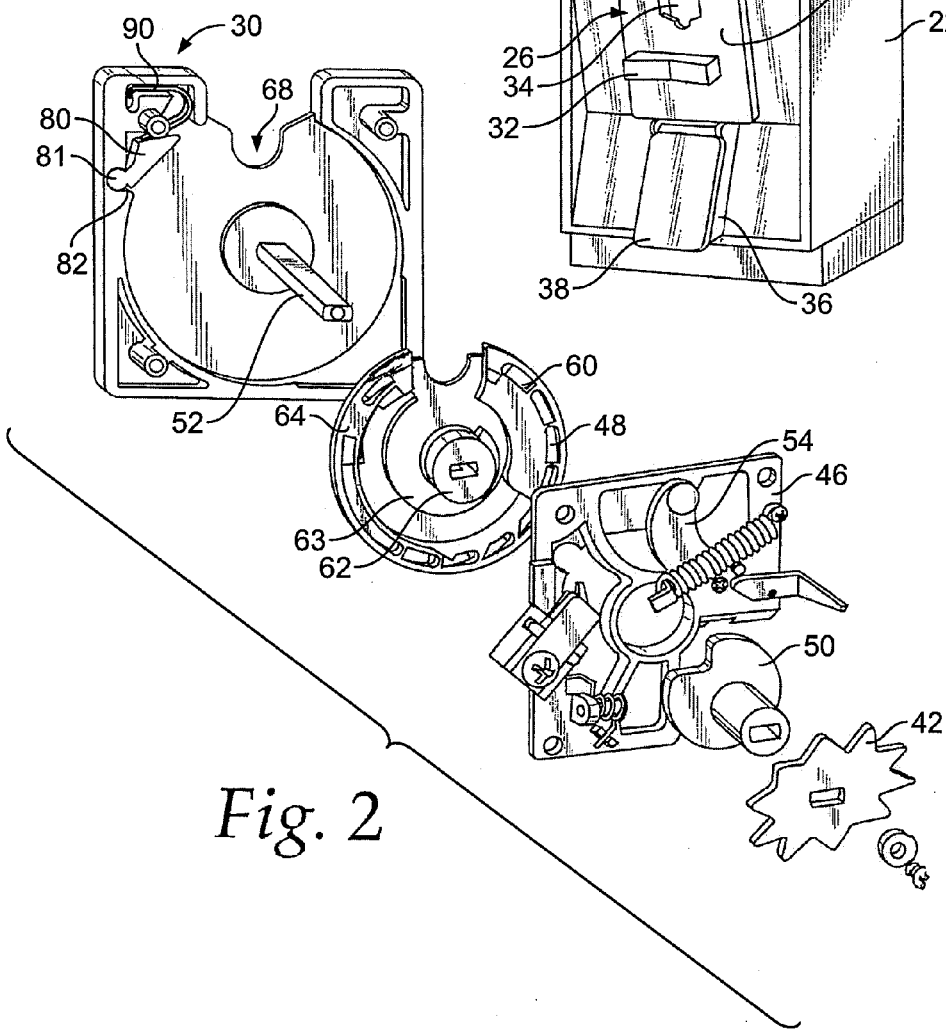
Fig. 2

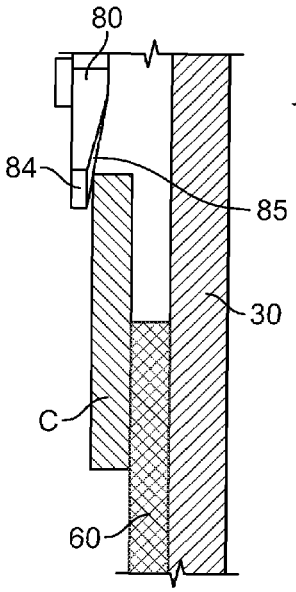
Fig. 7B
Fig. 8
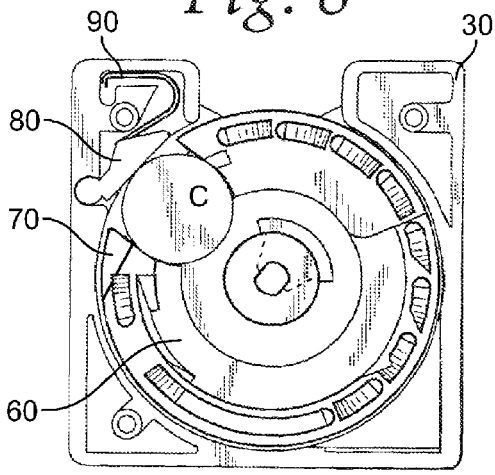
Fig. 9
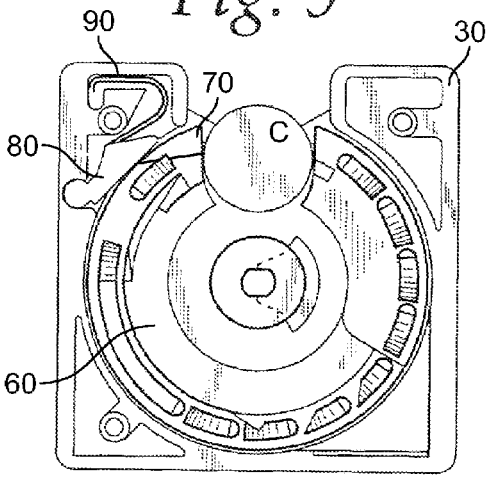
Fig. 10
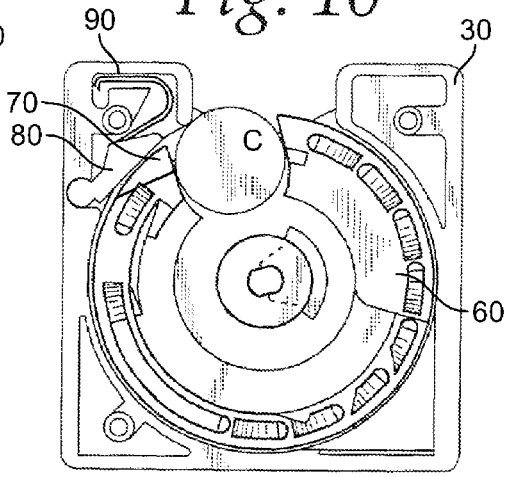

Fig. 11
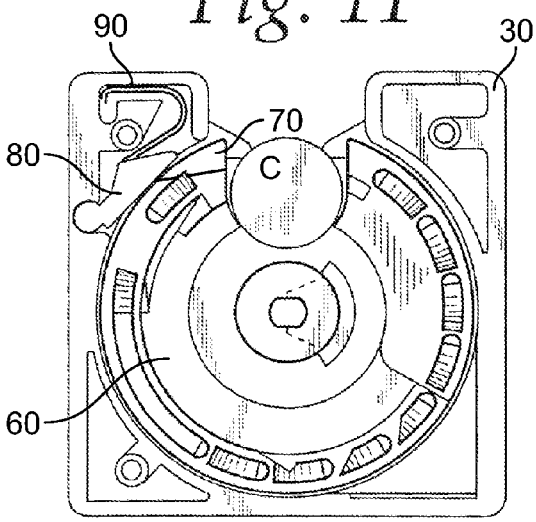
Fig. 12
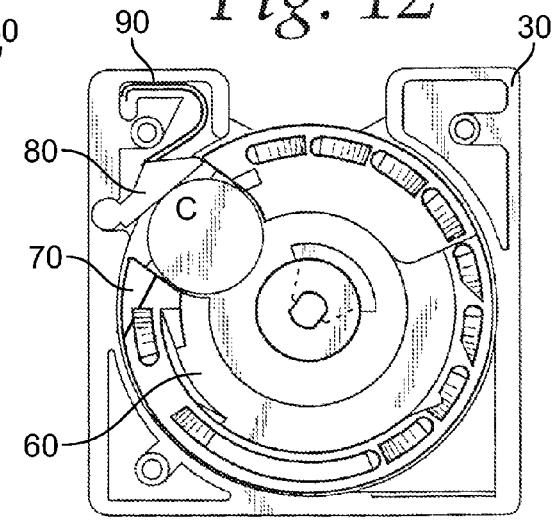
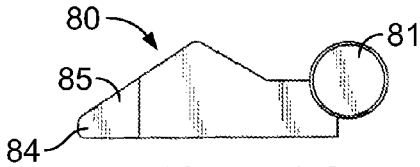
Fig. 13
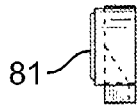
Fig. 15
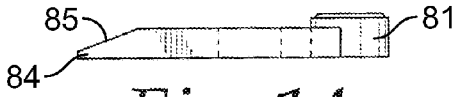
Fig. 14

COIN MECHANISM

This invention relates to an improved coin receiving and processing mechanism for a bulk vending machine; and more particularly to a coin receiving and processing mechanism having a coin wheel and pawl which minimizes coin rotation and consequent coin wheel wear.

BACKGROUND OF THE INVENTION

Bulk vending machines occupy a special and important position in American commerce, not just because of the sales generated therefrom, but also because of a unique niche that these machines possess in the minds of the public. These bulk vending machines are very often found near the entranceway or lobby of supermarkets, department stores, and other retail stores in commercial districts and shopping malls throughout the United States. Proceeds from the bulk vending machines may augment the income of the store proprietor, or the proceeds may be shared with or donated to charitable organizations.

Bulk vending machines are intended to operate unattended and without regular supervision or attention by a person associated with the establishment where the machine is located. It is thus important that the bulk vending machine be highly reliable, durable, and resistant to vandalism or pilferage.

One part of the bulk vending machine that is susceptible to vandalism or pilferage is the coin receiving and processing mechanism. This coin mechanism typically includes a handle to be manually rotated, a faceplate, and a connected gear that engages and operates a merchandise dispensing mechanism. A coin wheel, connected to the handle and the gear, includes a coin pocket which is sized, shaped and adapted to receive a coin of the proper denomination, typically a U.S. quarter. But the coin pockets can be sized and shaped to accept any size of U.S. or other coins.

The coin receiving mechanism of a bulk vending machine typically includes mechanism which, in effect, distinguishes between a coin of the proper denomination and coins of improper denomination or counterfeit coins or slugs. Because these bulk vending machines are typically unattended, stand-alone devices not connected to an electric power source, these coin-receiving mechanism operate without relying on any electric power source. Typically, coin receiving mechanisms use the dimension of the coin as a basis for acceptance or rejection.

U.S. Pat. Nos. 5,339,937 and 6,079,540 disclose and claim coin receiving mechanisms having a pawl located to contact a part of the coin wheel to stop rotational motion of the coin wheel unless a coin of proper denomination is inserted in the wheel coin pocket. These patents are incorporated by reference herein and are made a part hereof.

Experience has shown that, if these machines are used heavily, a coin received in the coin wheel pocket and engaged by the pawl tends to rotate in the pocket during machine operation. This coin rotational motion tends to wear the pocket, the coin wheel hub, and perhaps other parts of the mechanism so that the coin receiving and processing mechanism must be periodically replaced.

It is accordingly the general object of the present invention to provide a coin wheel and pawl mechanism which will inhibit coin rotation in the coin wheel pocket and consequent wheel and pawl mechanism wear.

It is an associated object to provide this coin wheel and pawl mechanism at an attractive production cost.

Other objects and advantages of the invention will become apparent upon reading the following detailed description and upon reference to the drawings. Throughout the drawings, like reference numerals refer to like parts.

BRIEF DESCRIPTION OF THE DRAWINGS

FIG. 1 is an isometric view of a bulk vending machine which employs the mechanism embodying the present invention.

FIG. 2 is an exploded view showing a coin wheel and pawl embodying the present invention, and other parts of the bulk vending machine operating mechanism.

FIG. 7B is a cross sectional view along line 7B-7B of FIG. 7A.

FIG. 8 is an elevational view of the coin wheel and pawl of FIG. 7A with the coin wheel further advanced.

FIG. 9 is an elevational view of the coin wheel and pawl of FIG. 7 with an oversized coin or slug positioned therein.

FIG. 10 is an elevational view of FIG. 9 with the coin wheel in an advanced position.

FIG. 11 is an elevational view of the coin wheel and pawl of FIG. 7 with an undersized coin or slug positioned therein.

FIG. 12 is an elevational view of FIG. 11 with the coin wheel in an advanced position.

FIG. 13 is an elevational view of the novel pawl.

FIG. 14 is a plan view of the novel pawl.

FIG. 15 is in elevational view of the pawl.

DETAILED DESCRIPTION

Figure 3:
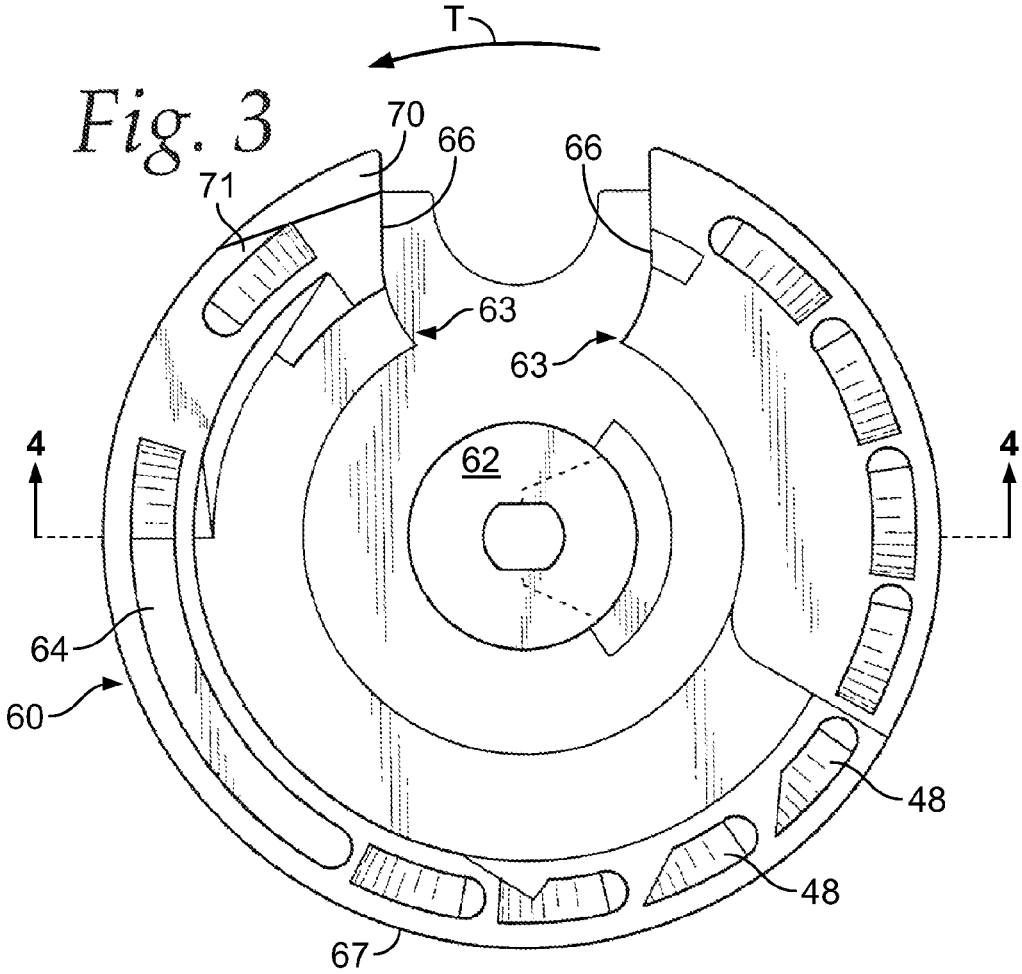
FIG. 3 is an elevational view of the coin wheel mechanism of the present invention.
Figure 4:
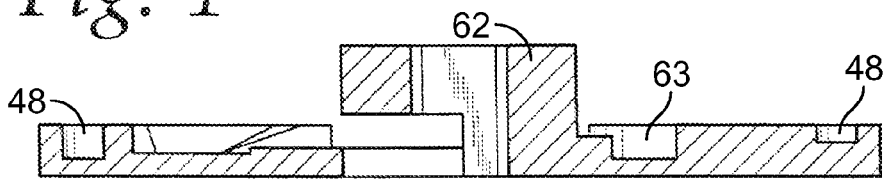
FIG. 4 is a sectional view taken substantially in the plane of line 4-4 in FIG. 3.

While the invention will be described in connection with a preferred embodiment, it will be understood that it is not intended to limit the invention to this embodiment. On the contrary, it is intended to cover alternatives, modifications and equivalents as may be included within the spirit and scope of the invention as defined by the appended claims.

Referring to FIG. 1, there is shown a bulk vending machine 20. The illustrated bulk vending machine 20 is a standard Model 60 bulk vending machine made by the Northwestern Corporation of Morris, Ill. The bulk vending machine 20 includes a base unit 22 and a product holder 24. The base unit 22 may be a generally rectangular metal housing, and the product holder 24 may be made of molded high-strength clear plastic. The present invention may be incorporated in bulk vending machines other than the model M60, such as the Triple Play model, also made by the Northwestern Corporation, or it may be incorporated in other bulk vending machines.

The bulk vending machine 20 includes a coin receiving and processing mechanism 26, which is mounted in the base unit 22. The mechanism 26 includes a faceplate 30 and a handle 32. When a coin of the proper denomination is deposited into a receptacle or slot 34 and the handle 32 is turned (here, counterclockwise) the coin mechanism 26 and dispensing mechanism (not shown) dispense a product, such as a gumball, down a chute 36 to a door 38.

The coin receiving and processing mechanism 26 is generally shown in FIG. 2, and can be like that disclosed and claimed in Northwestern Corporation's U.S. Pat. Nos. 5,339,937 and 6,079,540. A faceplate 30 mounts a rear frame 46. Behind this plate 46, a cam 50 and gear 42 are rotatably operated by a stem 52 affixed to the handle 32. A cam return lever 54 abuts the cam 50. Working together, the cam 50 and return lever 54 rotate the stem 52 so as to return the handle 32 to its starting position after it has been turned and a product has been dispensed, as more particularly disclosed in the '937 and '540 patents.

The stem 52 also turns the novel coin wheel 60. This coin wheel 60 comprises a stem-accepting hub 62, an intermediate web 63, and a peripheral raised rim 64. Slots 48 are formed in the rim 64 to be engaged by a finger (not shown) so as to prohibit wheel rotation in an improper direction.

Interrupting the rim 64 is a coin pocket 66 shaped and adapted to snugly receive a coin of predetermined size and denomination, such as a U.S. quarter. This coin pocket 66 is located on the wheel rim 64 so as to mate with a similar recess 68 formed in the faceplate 30.

The rim 64 is also partially interrupted, in an axial direction, to define a notch 70 sized and shaped to accommodate the presence of a pawl. This notch 70 has a base surface 71 extending directly from and communicating with the coin pocket 66. As suggested especially in FIG. 3, the notch 70 is located in a position leading the direction of travel of the coin pocket when the coin wheel 60 is turned in an operating direction as suggested by the arrow T in FIG. 3.

Figure 5:
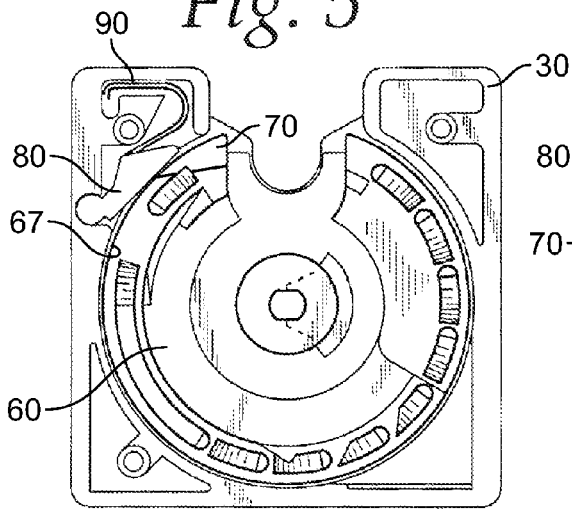
FIG. 5 is an elevational views of the coin wheel and pawl showing coin wheel in an initial non-advanced position without a coin positioned within coin wheel.
Figure 6:
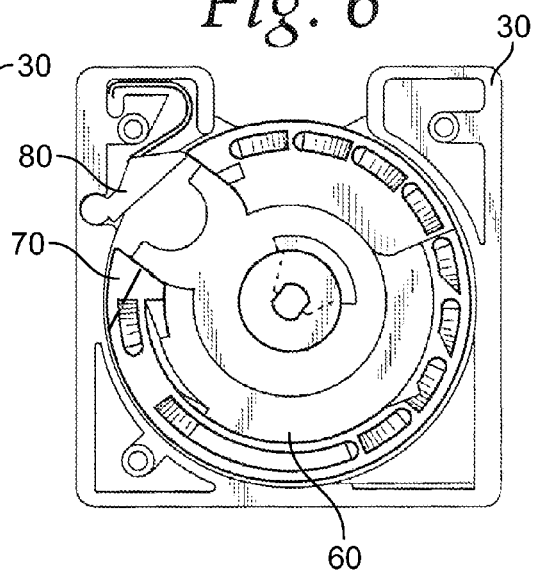
FIG. 6 is an elevational view of the coin wheel and pawl of FIG. 5 showing coin wheel in an advanced position.
Figure 7:
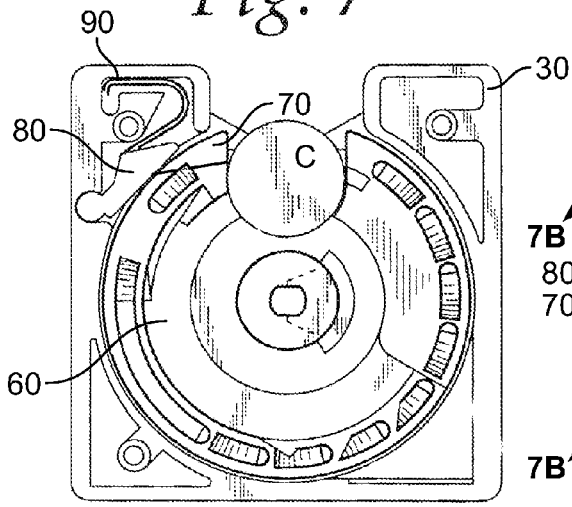
FIG. 7 is an elevational view of the coin wheel and pawl of FIG. 5 with the coin wheel in an initial non-advanced position with a proper sized coin within coin wheel.
Figure 7A:
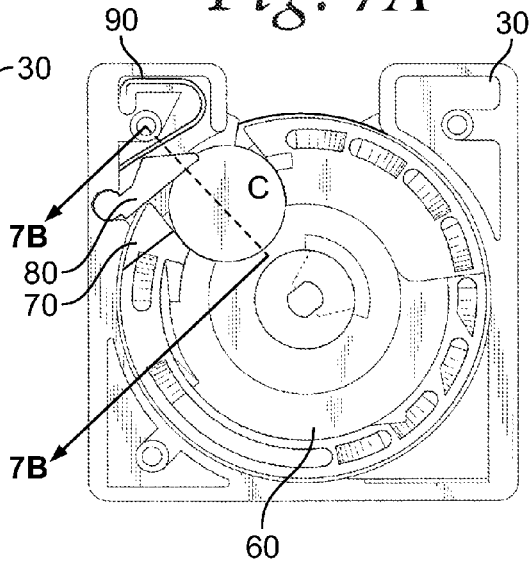
FIG. 7A is an elevational view of the coin wheel and pawl of FIG. 7 with coin wheel in an advanced position such that the pawl is initially engaging the coin.
Figure 16:
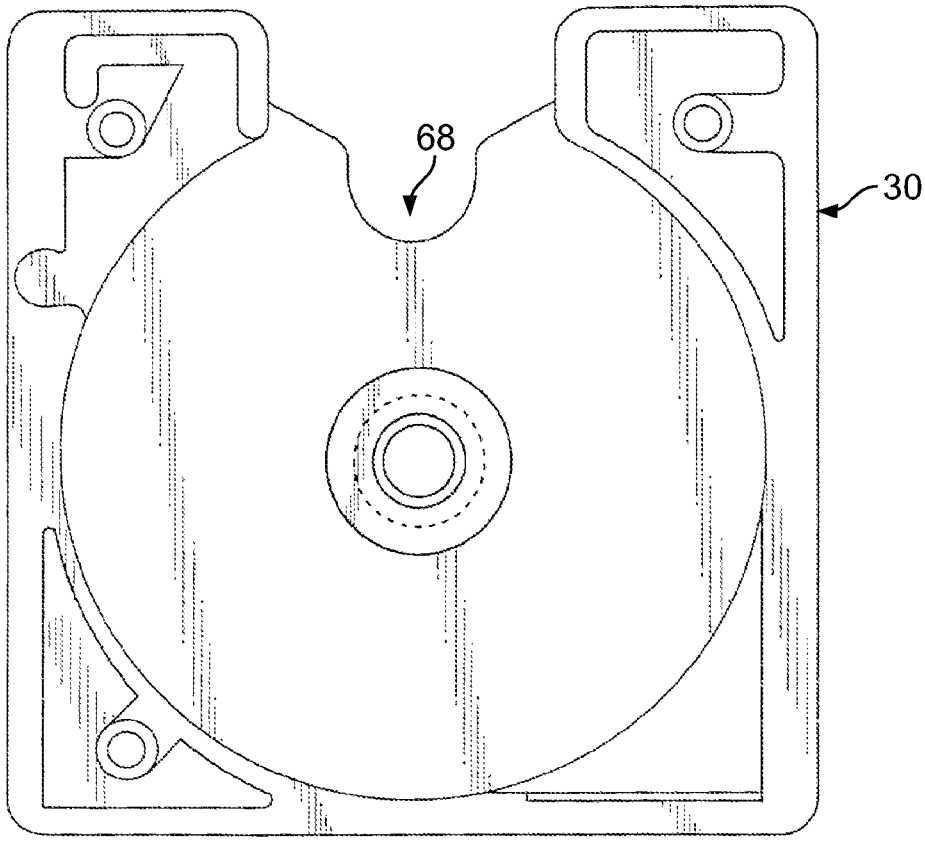
FIG. 16 is a front elevational view of the coin wheel and pawl mechanism base mounting plate.

Cooperating with the coin wheel 60 to prevent the introduction of unauthorized slugs or genuine coins of improper denomination is a pawl 80. As shown in FIGS. 2 and 5-12, this pawl 80 is mounted on the faceplate 30 by a journal formation 81 adapted to be received in a mating recess 82 in the faceplate 30. As suggested in FIGS. 5-12, this pawl 80 is biased into engagement with the outer periphery 67 of the coin wheel 60 (FIG. 3) by a biasing spring 90, which may include two nested elements for added resiliency and force, if desired. As suggested in FIGS. 5-12, the pawl 80 rides over the wheel rim periphery 67 as the wheel turns, and as the slot 70 is presented to the bottom of the pawl 80, the pawl 80 is depressed downwardly and to the right by the action of this spring 90. As seen in FIGS. 5 and 6, with no coin present, pawl 80 remains in its depressed downwardly position and strikes opposite corner of rim periphery 67 stopping further rotation of coin wheel 60. However, in the instance a properly sized coin is present, as shown in FIGS. 7, 7A, 7B and 8, with pawl 80 biased and depressed downwardly into slot 70, beveled surface 85 of tooth 84 engages a corner of the coin, as shown in FIG. 7B. As coin wheel 60 is further rotated, the coin is pressed against coin wheel 60 thereby reducing wear on coin wheel 60. As coin wheel further advances, the coin advances and moves away from the binding engagement of beveled surface 85 resulting in pawl 80 rotating such that pawl 80 clears and does not engage rim 64, as seen in FIG. 8. The coin wheel 60 then can be turned through a sufficient rotational displacement to operate the product dispensing assembly (not shown) and deliver the product to the chute 36 and dispensing door 38. If, however, the coin is too large as suggested in FIGS. 9 and 10, the coin strikes a part of the faceplate 30 and further wheel 60 rotation is prohibited. If the coin is too small as suggested in FIGS. 11 and 12, the pawl 80 enters the notch 70 and slides over the coin C so as to engage the opposite corner of the rim 64 as suggested especially in FIG. 12. The pawl 80 then prohibits further wheel 60 rotation.

As shown in FIGS. 13 and 14, the pawl 80 has a distal tooth 84 which engages the coin C as suggested in FIGS. 7-12. As is well known, U.S. quarters have serrated rims. It has been found that, under some circumstances, as the pawl tooth 84 (without a beveled edge 85) engages the serrated coin rim, the eccentric force applied to the coin causes the coin to rotate or turn in its pocket 66, 68. This rotation causes the coin rim serrations to engage and wear away parts of the hub 62 and, occasionally, parts of the web 63. Coin wheel replacement is then required.

To obviate this problem in accordance with the invention, the pawl 80 is provided with a beveled surface 85 so as to locate the tooth 84 at a position where it will engage the coin substantially at the coin corner; the pawl does not necessarily engage the entire coin rim. Preferably the pawl tooth is shaped and formed to engage a coin or disk located in the coin wheel pocket at a disk corner which is opposite the face of the coin wheel pocket. The coin is thereby forced into an oblique, non-rotational position against the wheel surfaces so that the coin will bind against the coin wheel surfaces, thereby minimizing coin wheel wear. Moreover, the coin (or a disk slug) is engaged by the pawl with increasing force as the coin wheel turns, and that force is in a chordal direction which is increasingly coincidental with the radius of the coin or slug. If the slug is formed of soft metal, plastic cardboard, or like material, the slug will be deformed by the pawl so as to interrupt coin wheel rotation.

The invention claimed is:

1. The combination of a pawl and coin wheel for use in a bulk vending machine, the coin wheel comprising a stem-accepting hub, a web and a peripheral rim, the rim being interrupted to define, together with the web, a coin pocket sized and shaped to snugly accept a disk of pre-determined dimensions, the peripheral rim being additionally interrupted to define a notch sized and shaped to accommodate the presence of the pawl, the pawl being journaled for limited rotation about a center of rotation located outside the coin wheel, the pawl comprising a beveled surface configured to extend across and engage a corner of the disk, opposite the face of the coin pocket, at an angle oblique to the face of the disk with the disk located in the coin pocket to force the disk into an oblique, non-rotational, binding position against the coin pocket surfaces, so as to inhibit disk rotation in the coin pocket.

2. A device according to claim 1 wherein said notch has a base surface extending directly from and communicating with said coin pocket.

3. A device according to claim 2 wherein said notch is located in a position leading the direction of travel of the coin pocket when the coin wheel is turned in an operating direction.

4. A device according to claim 1 wherein said beveled surface is offset from the center of rotation so that the pawl engages a miss-sized disk in the coin pocket with increasing force as the coin wheel turns.

5. A device according to claim 1 wherein said pawl is shaped so as to locate said beveled surface to engage a disk located in the coin wheel pocket at a disk corner, which is opposite the face of the coin pocket.

6. The combination of a pawl and coin wheel for use in a bulk vending machine, the coin wheel comprising a shaft-accepting hub, a web and peripheral wheel rim, the wheel rim being interrupted to define, together with the web, a coin pocket sized and shaped to snugly accept a disk of pre-determined dimensions, the peripheral rim being additionally interrupted to define a notch sized and shaped to accommodate the presence of the pawl;

the pawl having a disk-engaging beveled surface configured to extend across and engage a corner of the disk, at an angle oblique to the face of the disk with the disk in the coin pocket from a pre-determined direction, said direction being a projection of an imaginary chord of the disk, wherein said pawl is shaped so as to locate said beveled surface to engage the corner of the disk, opposite the face of the coin pocket, to push the disk into the coin pocket so as to inhibit disk rotation in the coin pocket.

7. A mechanism according to claim 6 wherein said pawl is shaped so as to locate said beveled surface to engage a disk located in the coin pocket substantially at a disk corner.

8. The combination of a toothed pawl and coin wheel for use in a bulk vending machine, the coin wheel comprising a shaft-accepting hub, a web and peripheral wheel rim, the wheel rim being interrupted to define, together with the web, a coin pocket sized and shaped to snugly accept a disk of pre-determined dimensions, the peripheral wheel rim being additionally interrupted to define a notch sized and shaped to accommodate the presence of the pawl;

wherein said pawl comprises a beveled surface configured to extend across and engage a corner of the disk, at an angle oblique to the face of the disk with the disk located in the coin pocket to push the disk against an opposite face of the coin pocket so as to inhibit disk rotation in the coin pocket.

9. A coin mechanism for a bulk vending machine comprising, a frame;

a coin wheel comprising a coin pocket sized and shaped to accept a disk of pre-determined dimensions, wherein the coin wheel is rotationally mounted to the frame; and a pawl secured to the frame comprising a beveled surface, configured to extend across and engage a corner of the disk at an angle oblique to the face of the disk with the disk positioned in the coin pocket, so as to inhibit disk rotation in the coin pocket.

10. The coin mechanism of claim 9, wherein the pawl is positioned so as to force the disk into an oblique, non-rotational, binding position against a surface of the wheel pocket.

11. The coin mechanism of claim 10, wherein the pawl is positioned so that the beveled surface engages the corner of the disk with increasing force as the coin wheel is rotated with increasing force.

12. The coin mechanism of claim 11, wherein the disk is constructed of at least one of soft metal, plastic, and cardboard.

13. The coin mechanism of claim 12, wherein the pawl is positioned so as to deform the disk and engage the coin pocket, thereby preventing further rotation of the coin wheel.

14. The coin mechanism of claim 9 wherein the coin wheel is interrupted to define a notch sized and shaped to accommodate the presence of the pawl.

15. The coin mechanism of claim 9 further comprising a faceplate mounted to the frame, wherein the coin wheel is positioned in between the faceplate and the frame.

16. The coin mechanism of claim 15 wherein the pawl is mounted on the faceplate and secured to the frame by a journal formation adapted to be received in a mating recess in the faceplate.

* * * * *